US005850716A

United States Patent [19]

Thompson et al.

[11] Patent Number: 5,850,716

[45] Date of Patent: Dec. 22, 1998

[54] FLOORING SYSTEM

[76] Inventors: Jeffrey H. Thompson, 4124 Queen Ave. South, Minneapolis, Minn. 55410; Charles L. Amlaw, 4820 Larkspur La., Edina, Minn. 55435

[21] Appl. No.: 937,230

[22] Filed: Sep. 8, 1997

Related U.S. Application Data

[63] Continuation of Ser. No. 553,079, Nov. 3, 1995, abandoned.

[51] Int. Cl.[6] ..... E04F 11/16; F04B 5/00

[52] U.S. Cl. ..... 52/177; 52/33; 52/36.4; 52/459; 52/470

[58] Field of Search ..... 52/177, 179, 36.4, 52/36.2, 36.1, 181, 468, 459, 403.1, 302.1, 480, 33, 470, 471

[56] References Cited

U.S. PATENT DOCUMENTS

| | | | |
|---|---|---|---|
| 1,619,773 | 3/1927 | Van Der Pyl | 52/181 |
| 3,158,962 | 12/1964 | Faase | 52/181 X |
| 4,067,155 | 1/1978 | Ruff et al. | 52/468 X |
| 4,306,388 | 12/1981 | Yuter | 52/36.1 X |
| 4,381,324 | 4/1983 | Ellingson, Jr. | 52/177 X |
| 4,455,997 | 6/1984 | Naka | 52/179 |
| 4,557,475 | 12/1985 | Donovan | 52/177 X |
| 4,766,020 | 8/1988 | Ellingson, Jr. | 52/177 X |
| 4,893,449 | 1/1990 | Kemper | 52/464 |
| 4,913,576 | 4/1990 | Grant, Jr. | 52/396.04 X |
| 4,948,116 | 8/1990 | Vaux | 52/177 X |
| 5,092,094 | 3/1992 | Duda et al. | 52/459 X |

OTHER PUBLICATIONS

Wade Tyler Specification Drainage Products, Tyler Pipe/ Wade Division, Tyler, TX. Aug. 1995, pp. 61 and 97.

Altro Safety Floors, Altro Stronghold 35, Product Samples, Jan. 1992.

Altro Floors Specification Guide, Slip Resistant Vinyl Sheet Flooring, §09650, Jun. 1995, pp. 1–4.

Altro Safety Flooring Installation Guide, Mar. 1995.

Coral Plus Extra Clean–Off–Zone by Tufton, Product Samples, dated before Nov. 3, 1995.

Coral Plus Extra Clean–Off–Zone by Tufton, Product Description, dated before Nov. 3, 1995.

Altro Sheet Vinyl Safety Flooring Product Catalog, dated before Nov. 3, 1995.

Brochure entitled "As Far as the Coral Clean–Off–Zone and Not a Step Further," dated before Nov. 3, 1995.

Brochure entitled, "A Winner on Every Sport Surface," Mondo Sport Division, dated before Nov. 3, 1995.

Versaflex All Purpose Rubber Underlayment, Product Description, dated before Nov. 3, 1995.

*Primary Examiner*—Carl D. Friedman
*Assistant Examiner*—Winnie S. Yip
*Attorney, Agent, or Firm*—Merchant, Gould, Smith, Edell, Welter & Schmidt, P.A.

[57] ABSTRACT

A flooring system is presented. The flooring system is uniquely designed to provide advantageous flooring in work places that are subject to substantial water and/or grease exposure and high traffic. The materials provide advantage with respect to protection of underlying subfloor and walls. In addition, effective arrangements for sealing around drains and fixtures are provided.

12 Claims, 10 Drawing Sheets

FLOORING SYSTEM

This application is a continuation of application Ser. No. 08/553,079, filed Nov. 3, 1995, now abandoned.

FIELD OF THE INVENTION

The present invention concerns flooring systems. It is particularly concerned with unique systems for use in areas having some or all of the following characteristics: high traffic flow; standing operators; frequent water use; need for frequent and aggressive cleaning; and, problems with greases, oils, and/or biological growth. Methods concerning such a flooring system are also presented.

BACKGROUND OF THE INVENTION

Herein, the terms "flooring", "flooring systems" and variants thereof generally refer to the material positioned on a subfloor or base, to create a walking/ working floor surface. The term includes underlay material.

In general, flooring systems are often designed with emphasis or focus on the principal use perceived for the floor. For example, if a floor needs to be hard and flat, for traffic flow involving the rolling of carts thereacross, a smooth cement, vinyl or vinyl tile surface may be used. While such a flooring may be desirable for the movement of carts and the like thereacross, it may be too slippery for use in an environment in which grease, oil or water spillage is prevalent. It also may be undesirable for a location where personnel must stand in one location on the surface, for a substantial period of time.

In environments wherein water spillage or grease accumulation is common, ceramic tile flooring is often specified and used. At least one problem with such systems is that the grouting between the ceramic tile provides undesirable locations for collection of water, grease and eventually bacteria. Thus, eventually damage will occur to the floor material or to the structural material on which the floor is positioned, i.e. typically wood or concrete base under the floor. In addition, ceramic surfaces are very hard and uncomfortable to stand on for long periods of time. Also, because of the grouting and the nature of ceramic tiles, seals around such features as pipes, drains, and other fixtures are difficult, if not impossible, to effectively achieve and maintain.

Because surfaces such as ceramic tiles are so hard, often anti-fatigue mats are placed (not secured) on them, to reduce injury to the workers. The anti-fatigue mats serve as trip hazards, however. Also, they may be in the way of the movement of rolling carts, across the floor surface. In addition, they can undesirably collect greases and biological materials, and thus serve as sources of bacterial growth. This problem is exacerbated by the fact that large mats are difficult to maneuver and effectively clean, especially at locations which do not have special facilities for their cleaning.

One particular environment which: is subject to high traffic flow, has stations where workers stand for long periods of time operating equipment, involves frequent exposure of the flooring to water and grease, often involves rolling cart use, and which involves a need for frequent cleaning and maintenance of biological control and related problems, is that of a typical commercial kitchen. This would, for example, be the type of kitchen found in restaurants, hotels or even commercial food preparation areas. Although state and municipal governments, and contract consultants, often prescribe specific materials to be used in such flooring, or characteristics such materials should possess, in general the conventional arrangements have not been fully satisfactory, due primarily to the fact that the conventional arrangements specified in the past have been undesirable with respect to addressing all types of concerns discussed above.

Other areas, besides kitchens, which have many of the same types of problems include: medical rooms such as operating rooms; grocery stores, tub rooms, showers, toilets, scrub areas, bar areas, hydrotherapy areas.

SUMMARY OF THE INVENTION

According to the present invention, a flooring system is provided. The flooring system includes a floor having a subfloor. The subfloor includes a recessed portion and an unrecessed portion, in many typical applications. A cushioning underlayment is positioned in the recessed portion of the subfloor. The cushioning underlayment has an upper surface and the cushioning underlayment is positioned such that the upper surface is at a height about equal to the height of the unrecessed portion of the subfloor. In preferred flooring systems according to the present invention, a flexible polymeric flooring sheet material is secured the unrecessed portion of the subfloor and also over the cushioning underlayment. Flooring systems according to the present invention may involve subfloors having more than one recessed portion, each of which is filled with cushioning underlayment.

Flooring systems according to the present invention may be utilized in a variety of locations, however the preferred materials described herein are particularly selected because they are perceived as advantageous for use in a kitchen flooring area. In such an arrangement, the recessed area underneath the polymeric flooring sheet material will be preferably located in front of a cooking line, a dishwashing area or both.

In preferred flooring systems according to the present invention, at least one drain fixture will be positioned in the floor. Preferably the drain fixture is a circular drain fixture including at least a drain funnel portion and a clamp member. The drain funnel portion is preferably set in the subfloor, with a lip of flexible polymeric flooring sheet material extending down into a flared end of the drain portion. The clamp member is then secured to the drain portion, with the lip or recessed area of the flexible flooring sheet material clamped therebetween. Typical drain fixtures used in arrangements according to the present invention will then include a top porous grid or grate, for draining water and similar materials from the floor.

Also in certain preferred arrangements according to the present invention, elongate trough fixtures are used. Preferably the trough fixtures are generally rectangular in configuration. The trough fixtures also preferably include a base drain or gutter, and a clamp member. Preferably the base drain is positioned in the subfloor, with a lip of the flexible polymeric flooring sheet material extending downwardly into the base drain. The clamp member is then preferably secured to the base drain, with the lip of flexible polymeric sheet material clamped therebetween. Again, typical trough fixtures will include a perforated or porous grid or grate, positioned on a portion of the clamp member. Preferably the clamp member includes a recessed grid rim, or shelf, to accommodate this.

In certain preferred arrangements according to the present invention, a floor is provided with a section having bristled flooring material secured to the subfloor. The bristled flooring material preferably comprises tufts of debris-trapping bristles secured to a flexible polymeric backing. Preferably the polymeric backing is a vinyl or latex backing. Preferably the tufts of debris-trapping bristles comprise tufts of nylon material.

According to the invention, certain transition seal strips for use at seams between sections of flooring material are provided. The transition seal strip preferably comprises a base plate which is secured to the subfloor, underneath the portions of flooring which are brought together at the seam. The transition seal strip also preferably includes a top plate which is secured to the bottom plate, with portions extending over edges of the adjoining flooring material.

Preferably the flexible polymeric flooring sheet material comprises a vinyl flooring, most preferably a vinyl flooring including a skid-resistant upper surface.

BRIEF DESCRIPTION OF THE DRAWINGS

In the drawings, relative material thicknesses may be shown exaggerated, to facilitate understanding.

DETAILED DESCRIPTION

A Typical Environment for Use of a Flooring System According to the Present Invention: A Commercial Kitchen As will be apparent from the following detailed description, systems according to the present invention will find use and application in a wide variety of environments. However, the principles of the present invention, and advantages that can be achieved from it, will be described herein in connection with an application in a commercial kitchen environment. As will be apparent from further descriptions, a reason for this is at least in part that commercial kitchen environments are not only regulated, but they also present many of the numerous problems and concerns that flooring systems according to the present invention are designed to address.

Consider, for example, a typical commercial kitchen having the kitchen floor plan of a typical restaurant. An example of such a floor plan is shown in FIG. 1, in schematic.

Figure 1:
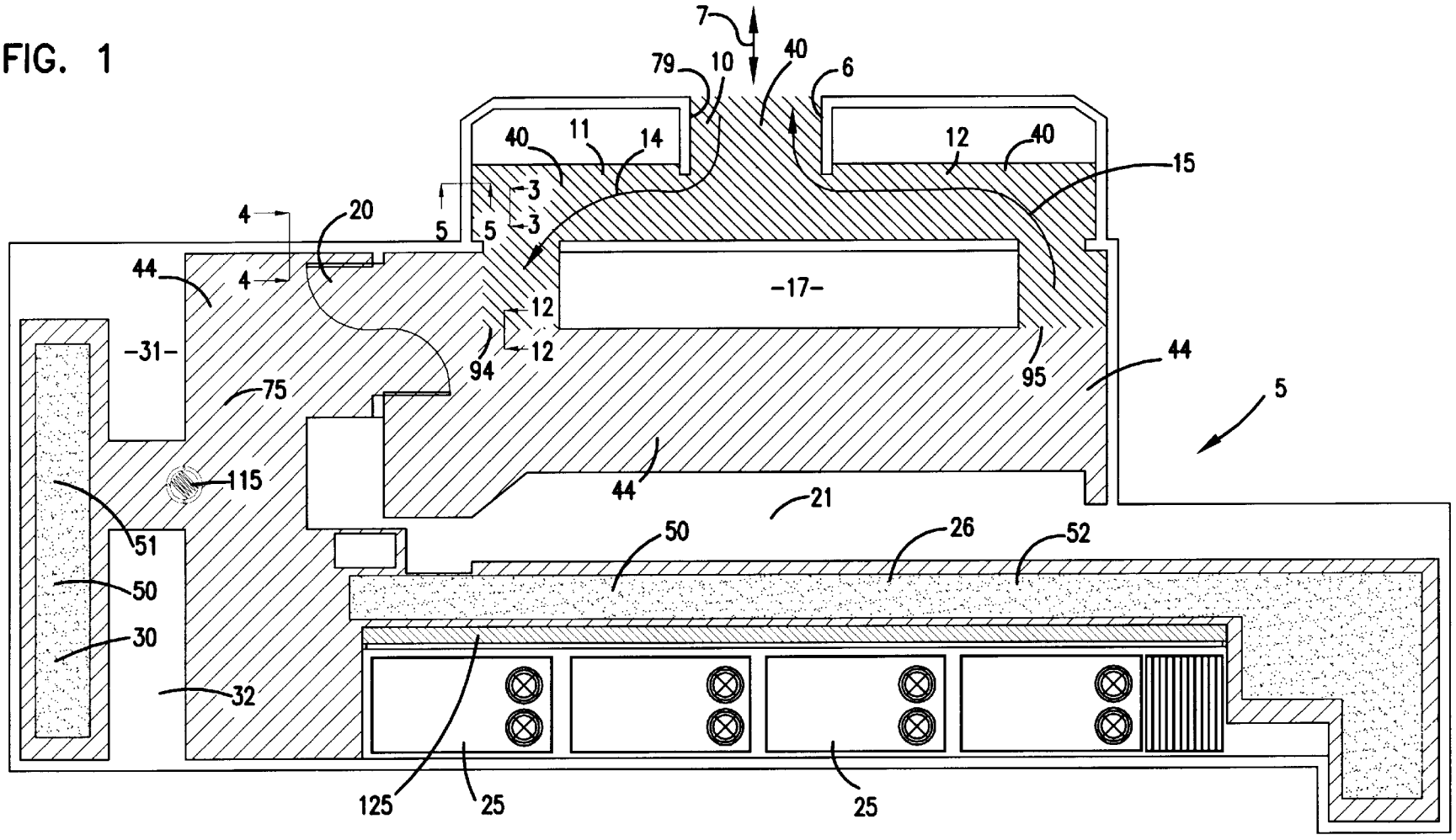
FIG. 1 is a schematic floor plan of a commercial site having installed thereat a flooring system according to the present invention.

Referring to FIG. 1, the kitchen is generally indicated by reference numeral 5. At 6, a doorway to a dining area is shown. Traffic flow into and out of the dining area is generally indicated by double-headed arrow 7.

For a busy restaurant, doorway 6 is a high traffic flow area. In general, wait staff, host staff, management personnel, buspersons, etc. will be moving into and out of kitchen area 5 via doorway 6 on a more or less continual basis, during working periods.

Still referring to FIG. 1, at 10 an entry area (or entryway) for the kitchen is shown. As with many kitchen floor plans, entry area 10 is divided into two traffic flow areas as is indicated at 11 and 12. At arrow 14 in area 11, traffic flow into the main portion (main high traffic floor area) of the kitchen is shown. At arrow 15, traffic flow out of the main portion of the kitchen is illustrated. Kitchens are often divided in this manner, to avoid interference with smooth traffic flow. Of course such is not required, but is often desired.

At 17, a beverage line is indicated. At this region access to water, coffee, beverages, etc., delivered to customers in the dining area almost immediately upon seating, is provided for the waitpersons. Thus to receive and distribute these items, the waitpersons do not generally have to move all the way into the main kitchen area.

At 20, the main kitchen floor area is generally indicated. At 21, a food pickup line or counter is shown. This would be the location whereat waitpersons or wait staff pick up food prepared by the chefs, to deliver same to the dining area. The food pickup line or counter 21 is positioned adjacent the food preparation line 25. Line 25 would include such equipment as the stoves, ovens, grills, work areas, etc. for the food preparers. The food preparers (chefs, cooks, etc.) would generally stand along the cooking line floor area indicated at 26, throughout much of their shifts. They could then prepare the food while working at the food preparation line 25, and simply turn to place it on the food pickup counter 21.

Still referring to FIG. 1, at 30 the dishwashing area is shown. At 31, a drop-off counter is depicted, for dirty dishes, etc. The dishes are then cleaned in the dishwasher area 30, as needed, and are returned to the appropriate storage areas 32 for further use. Often workers assigned to dishwashing duties will work while standing, in area 30, for extended periods.

Many kitchen areas include more regions than presented in the discussion of the schematic of FIG. 1. For example, an office area, employee lounge, etc. may also be included. Further, the designs may differ substantially from the floor plan of FIG. 1. However, the regions indicated with respect to FIG. 1 reflect certain general operations that are conducted to some extent in almost all commercial kitchens, and reflect the types of equipment and activities that are involved.

As one considers the environment of an active commercial kitchen, a variety of concerns become apparent. First, it is often desirable that the floor be such that carts can be rolled thereacross, with little difficulty. These would include, for example, carts that are used for loading dirty dishes, etc.; carts that are used to move food into the dining areas; and, carts that are used to move food materials and equipment around the kitchen area. It is desirable, then, to have a flooring system relatively free of obstructions that would inhibit convenient cart movement and operation. It is also preferable to have a relatively flat floor surface, not only to facilitate cart movement, but also to reduce kitchen noise.

In addition, commercial kitchen areas involve the generation of a substantial amount of airborne grease and oils. These will become absorbed or adsorbed into the walls and flooring materials. In many systems, this can create, in time, a grease film on the flooring. Also water spills are frequent in kitchens. These are undesirable for many reasons. For example, grease or water will eventually make the floor somewhat slippery, and thus hazardous. In addition, grease films can be very difficult to clean from the floors, and eventually can present health hazards. Also, such materials as grease and water provide growth sites for bacteria, not only exacerbating the health hazard problems, but also failure of the structural components in the floor. Finally, should such greases, water or bacterial growth continue into the subflooring or walls, damage to these materials (for example rot) can occur resulting in a weakening of the floor or wall, and requiring substantial contract work for repair.

Of course kitchen areas are areas which must be aggressively and frequently cleaned. This means that the flooring will be exposed to frequent washings and scrubbings, sometimes involving very aggressive and abrasive cleaning regimens. Also the areas near the dishwashing equipment, etc. will be subject to large amounts of water spillage.

The materials of the flooring, then, should be of the type that will not become unacceptably slippery if it should become wet during the working day, and also which will not readily be damaged by water. Further the flooring should preferably be a material which water cannot pass through, into the subflooring or wall area, again to inhibit undesirable amounts of rot and structure damage.

The material utilized in the flooring for many commercial kitchens is quarry tile. Indeed quarry tile is frequently specified in state and local specifications, for acceptable commercial kitchen flooring. Quarry tile is generally ceramic, made from fired clay. It can be made in a form very resistant to water and grease damage, and bacteria damage.

Quarry tile is somewhat porous. Such tile creates grease traps and eventually oil/grease films are generated by the tiles themselves, as the oil/grease leaches back to the surface in time.

There are many other shortcomings of quarry tile. For example, the grout that is used between the tile pieces, typically a conventional cement, is rather porous and does absorb/adsorb water and grease. Further, it often cracks or chips, allowing even greater amounts of leakage to the subflooring, etc. Thus, even though the quarry tile can protect the subflooring reasonably well, in general the tile cannot be put in place without generation of seams, including grout, that are not desirable for resistance to water leakage, grease permeation and eventual damage.

In addition, the grouting between tiles creates a "non-flat" surface. As a result, carts tend to rattle over the flooring, and are not as easy to push across the flooring as would be preferred.

In addition, ceramic tile flooring is very hard. It is undesirable for use in areas where workers will stand for long periods of time. Indeed in many kitchen areas where ceramic tile is utilized as the flooring surface, anti-fatigue mats are typically placed on top of the flooring. This is common, for example, in front of cooking lines.

As generally indicated above, it is preferable to avoid the need for utilization of anti-fatigue mats in kitchens altogether. The mats are expensive, they provide trip hazards and biohazards, and they are difficult to clean. They are also undesirable obstructions to the passage of carts, etc. through the kitchen area. Thus, most preferred systems according to the present invention are "anti-fatigue mat free".

Another problem with ceramic tile is that it is difficult to seal to the kitchen fixtures, such as around pipes, drains, etc. Indeed, usually during construction the tile is simply cut to roughly fit around the fixture, and the spacing between the rile and the fixture is simply filled with grout. Thus a good seal cannot be obtained, and another site for potential damage is presented.

Finally, ceramic tile surfaces, since they do not absorb (or adsorb) either moisture or grease materials very significantly, provide little resistance to water, grease or food material being picked up on the workers' shoes, during use. Thus, it is relatively easy for the workers to track this material into the dining area. This is undesirable at least for aesthetics. To address this concern, sometimes cleaning mats are placed on top of the tile floor, at the entrance to the dining areas. Such mats, however, easily roll to present trip hazards and, as with anti-fatigue mats, can be difficult to clean and maintain. Thus, most preferred applications of the present invention concern floors which are free of mats that are not secured in place.

In order to address these concerns, flooring systems according to the present invention uniquely provide selected materials in certain regions of the floor. This can be understood by referring to FIG. 1 and the following characterizations. First, in the region generally indicated at 40, i.e. entryway area 10 and traffic flow areas 11 and 12, what is most desired is a flooring or floor surface which will tend to clean the workers' shoes of water, grease, dirt, food scrapings, etc. as the worker enters the dining area. As will be understood, the flooring in region 40 will be of a preferred material that can be readily cleaned of the water, grease, etc. it has collected and removed from the workers'shoes. Also, materials should be used in a manner to inhibit subflooring or wall damage in this region.

Still referring to FIG. 1, the region indicated at 44 is the high-traffic area of the main kitchen floor, but does not represent areas where workers will stand for long periods of time, such as in the cooking line or dishwashing area. That is reference numeral 44 generally indicates the open floor area of the kitchen where workers move on a continual basis, carts are moved around, etc., but it does not reflect the standing work stations, such as the dishwashing station and cooking station. In region 44 a flooring will be used which is not readily damaged by water or grease; which does not become slippery when water or grease accumulates on it, i.e. a material which can be readily cleaned; and, which provides other desirable properties for use.

In general, the regions indicated at 50 (i.e. the floor in front of the dishwashing equipment at area 51 and the floor in front of the cooking equipment at line 52) are regions of the floor where workers will stand for long periods of time, throughout much of their work shift. In these regions, the properties desired in region 44 are also needed; however, additional needs are presented, namely a form of cushioning to the floor to provide for worker comfort.

As will be more apparent from the further descriptions, it is preferable that the above be obtained with a system that generally provides for good sealing to inhibit the likelihood of passage of water, grease or bacteria from the kitchen area through to the subfloor or lower base portions of the walls. Also, good sealing around fixtures such as drains, etc. is preferably provided.

Figure 2:
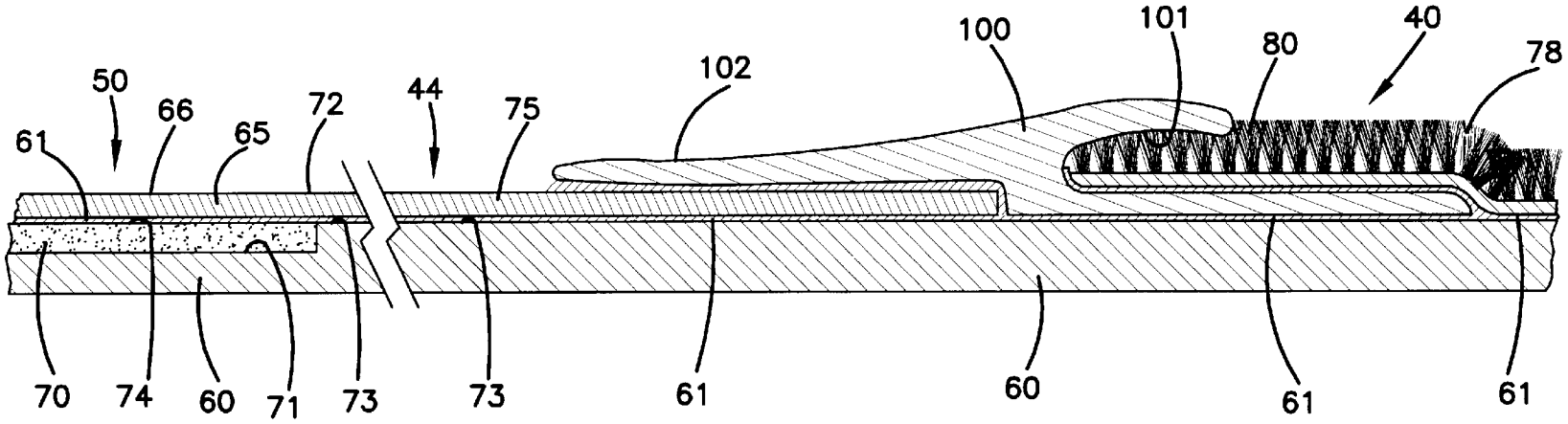
FIG. 2 is a fragmentary, schematic cross-sectional view depicting a portion of the arrangement shown in FIG. 1.

Attention is now directed to the schematic of FIG. 2. FIG. 2 is a schematic cross section, indicating the various regions 40, 44 and 50. In FIG. 2, the subflooring is indicated at 60. The subflooring may be of any conventional material, for example a wood floor or concrete floor may be involved. The flooring system according to the present invention is generally positioned on subflooring 60 and is secured thereto by adhesive 61.

Referring to FIGS. 1 and 2, attention is first directed to region 50, which reflects the flooring in the area of the dishwashing work area 51 or cooking line 52. These are the areas, again, where workers are expected to stand for long periods of time. In this area, the flooring comprises at least two types of materials, positioned on the subflooring 60. The first material or surface material 65 is a material which: will wear well; can be readily cleaned of water and grease; does not support bacterial growth to any substantial extent; can seal well around fixtures and the like; and, preferably, is flexible so that it can be curled at edges where walls or similar structures are encountered, to avoid floor level seams. Preferred such materials are flexible polymeric materials. In particular, vinyl flooring materials are preferred. Such materials can be laid from rolls, with seams avoided or removed, or at least minimized, through utilization of hot-welding techniques. Preferably vinyl flooring materials which are filled with sufficient amounts of fine granular material to provide for an skid-resistant upper surface 66 are desired. Preferably, except the skid-resistance provided by the small grains of particulate material which fill the vinyl, the upper surface 66 is flat and free from substantially topological features. That is, preferably the upper surface 66 of layer 65 is a relatively flat (but rough on a microscopic level from skid-resistant material) surface and, after installation, is relatively seam free. Preferred materials usable to accomplish this are described hereinbelow. Where seams are located, preferably they are filled with a polymeric weld. Such seams may provide some small rib or bump in the otherwise flat floor surface, but such effects will not pose significant problem. Indeed since material 65 is preferably provided from a flexible, polymeric flooring sheet material that can be provided from large rolls, with good planning the number of seams can be held to a minimum.

In regions 50, underneath surface layer 65, is preferably provided a cushioning underlayment sublayer 70. Cushioning sublayer 70 is preferably a material which has some sponge or give, for comfort to individuals standing on surface 65 in those locations. Materials such as are used for subcushion layers under athletic floors will generally be preferred. Preferred materials are described hereinbelow. In preferred systems, the cushioning sublayer 70 is positioned in a recessed portion 71 of the subflooring 60 so that the upper surface 66 of surface material 65 can be positioned substantially level with the flooring area it immediately adjoins. This is indicated, for example, at region 72, FIG. 2. Alternately stated, subfloor 60 includes recessed area 71 and unrecessed area 73. The surface material 65 comprises a flexible polymeric flooring sheet material positioned to extend over both, since underlayment 70 fills recessed portion 71 to a level even with unrecessed area 73. That is, upper surface 74 of underlayment 70 is even with surface 73 in subfloor 60. Of course, the subfloor 60 may include more than one recessed portion filled with underlayment. In FIG. 1, such areas are indicated at 51 and 52.

Attention is now directed to region 44, FIG. 2. Region 44 is the high traffic area in the main part of the kitchen. Preferably the flooring material in region 44 comprises a layer 75 of material directly positioned on unrecessed portions of the subflooring 60. There is not a need, in these locations, for intervening floor layers for cushioning, since workers are not generally standing in these areas for large periods of time. Otherwise, the characteristics desired in region 44 are generally similar to those desired in region 50, i.e. good wear; flat surface with good sealing; avoidance of substantial water and grease absorption (or adsorption); ease of cleaning or removal therefrom of water and grease, etc. Thus, preferably in region 44, the same type of flexible polymeric flooring sheet material as utilized in region 65 discussed above, is used. In fact, preferably the same material is used, and it is merely rolled across and set on subflooring 60 in these locations, without a cushioning layer thereunder. Thus, preferably the depth of recess 71 in region 50 is the thickness of the cushioning layer 70; and, during installation, the same material is used for the surface 65 in and area 50 as for area 75.

A further principal area of the flooring system is region 40, i.e. the high traffic area into and out of the dining area. In this region it is desirable to have a flooring which does tend to remove water, dirt, grease, etc. from workers' shoes passing thereover. Thus, preferably a fibrous material which tends to scrape shoes clean, and hold or trap water, particulates, etc. is desirable in this location. However, in general, conventional carpeting, as might be used in the dining area, is not preferred since such materials are difficult to clean and do not trap the materials from the workers'shoes extremely well. What is desirable in region 40 is a thickly bristled or coarsely bristled material such as shown at 78. Preferably, however, throw mats are not used because they can pose trip hazards, and do not provide good seals. Rather what is preferred is a material which is permanently secured to the subflooring in these locations. Indeed, preferably a material comprising coarse fibers secured to a polymeric backing, with the polymeric backing secured to the subfloor, is used in these locations. Preferred arrangements are those in which the backing is water and grease-proof and seals well to prevent water and grease migration to the subfloor. Vinyl backings (polyvinyl chloride) will generally be preferred. Preferred materials for this are discussed hereinbelow.

In FIG. 2, materials 75 and 78 are shown sealed in position by sealant 61. In addition, underlayment 70 may also be sealed down by a sealant, not shown.

Preferred flooring systems according to the present invention may include still further features and advantages. For example, in region 40, FIG. 1, i.e. where the coarse bristle material is located, preferably a good seam or seal to the adjacent wall 79 is provided. Several options with respect to this are presented. Some options are shown in FIGS. 5 and 6.

Figure 5:
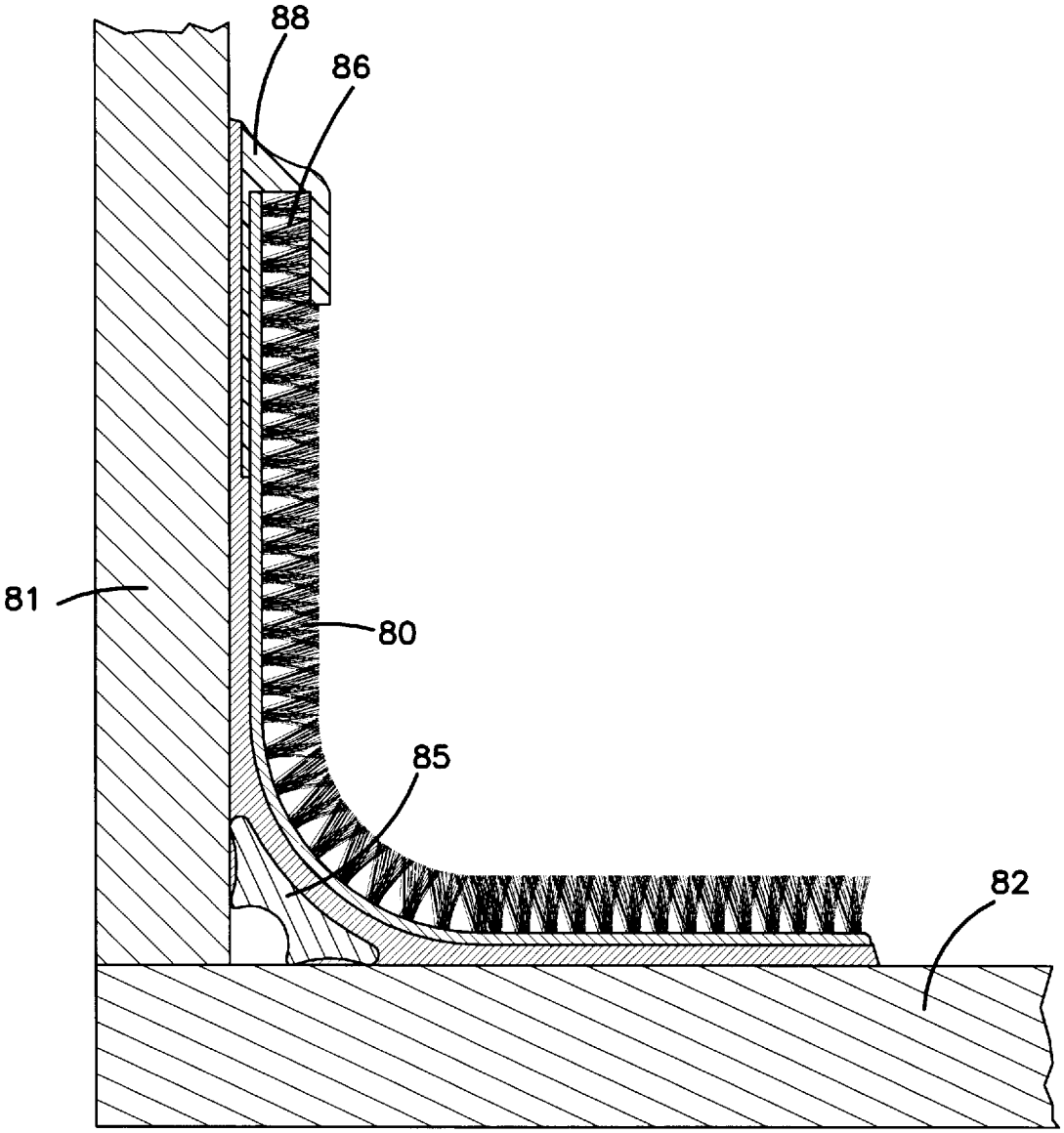
FIG. 5 is an enlarged fragmentary, schematic cross-sectional view taken along line 5—5, FIG. 1.

Attention is first directed to the option shown in FIG. 5. FIG. 5 is a cross section, showing the bristled material 80 as it abuts the wall 81. In particular, in FIG. 5, the subfloor underneath the bristled material is indicated at 82. At the corner between the subfloor 82 and the wall 81 is positioned an elongate "cove" piece 85. The bristled material 80 is then supported by the cove piece as it curls up the wall 81. Preferably it extends up wall 81 about 4 to 6 inches. Edge 86 of the bristled material 80 is positioned under an elongate edge strip 88. The edge strip 88 is secured in position, to cover the end of the bristled material 80. Appropriate sealant material can be used between the bristled material 80 and the wall 81, and between other adjoining surfaces, to ensure good seal.

Figure 6:
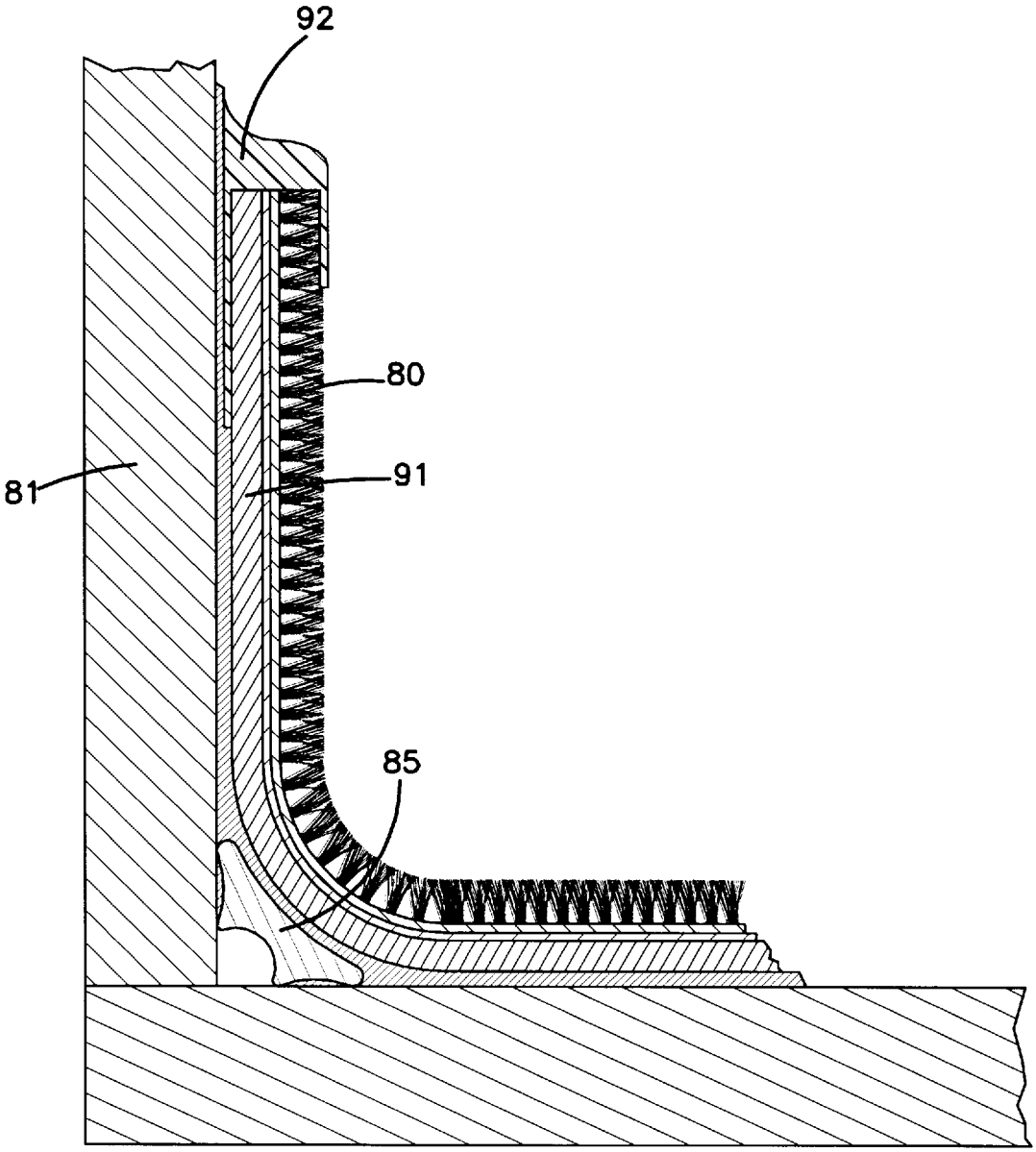
FIG. 6 is an enlarged cross-sectional view taken of an alternate construction to that shown in FIG. 5.

A second option is shown in FIG. 6. This option is generally analogous to that shown in FIG. 5. However, between the bristled material 80 and the wall 81, in this example, a sheet of flexible polymeric material 91 is positioned. The polymeric material 91 may be the same material as is used as the floor surface 65 in area 50. In FIG. 6, an edge strip is indicated at 92. It is anticipated that the option of FIG. 5 will be preferred over that of FIG. 6.

Referring again to FIG. 1, numerals 94 and 95 indicate edges whereat bristled material 80 terminates as the main floor area or region 44 of the kitchen is encountered. Herein several options with respect to providing this transition are described.

One option is shown in FIG. 2. In this option, an extension piece or transition strip 100 is located at this position. The piece is preferably molded from an appropriate polymeric material, preferably vinyl. The piece can be secured in place by appropriate adhesive or sealant field. The strip 100 includes a trough 101, for engagement with bristled material 80,and an overlapping lip 102, for securing over the sheet material 75.

Figure 11:
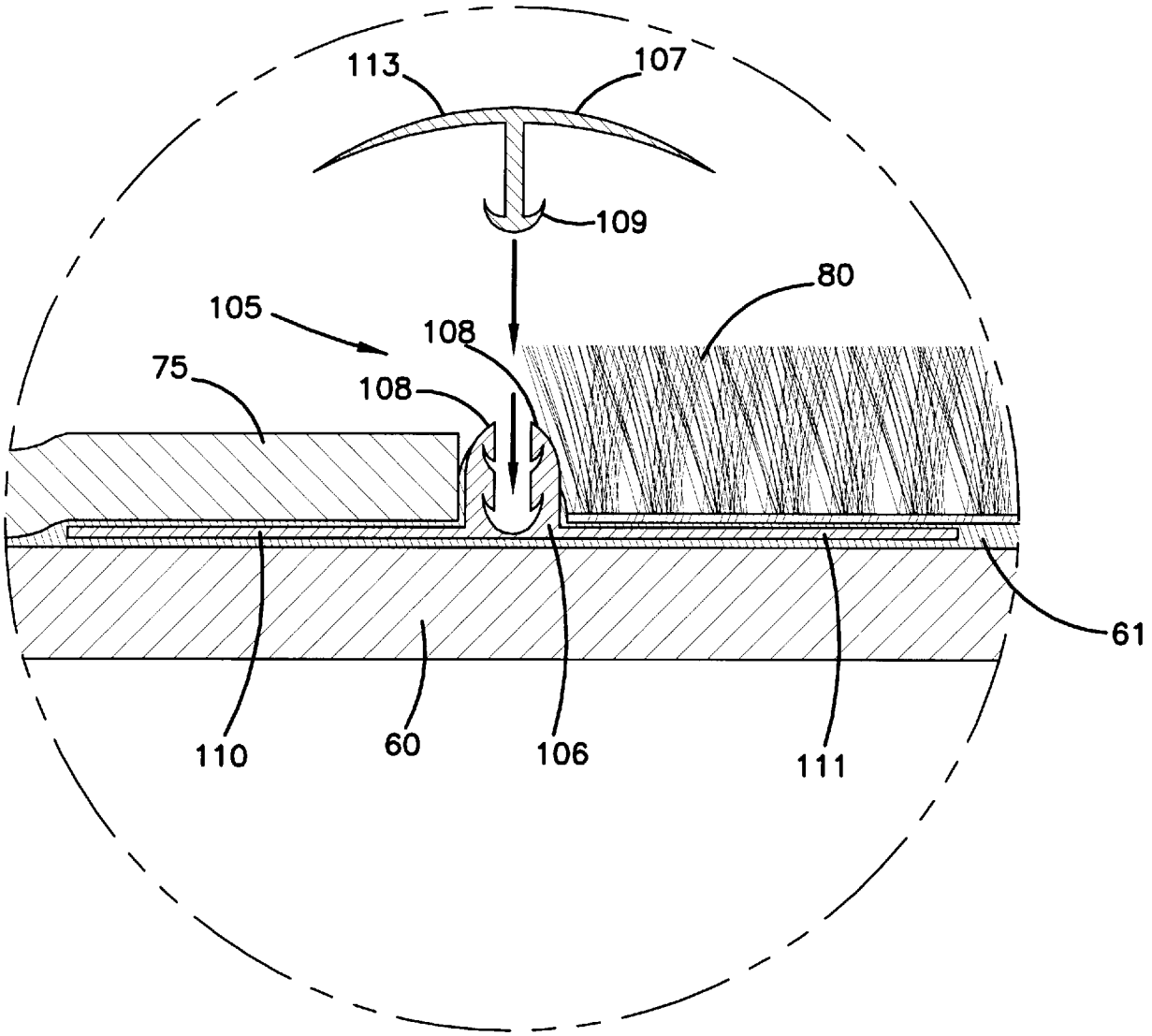
FIG. 11 is an enlarged, fragmentary schematic view of an alternate embodiment to a portion of the embodiment shown in FIG. 2.
Figure 12:
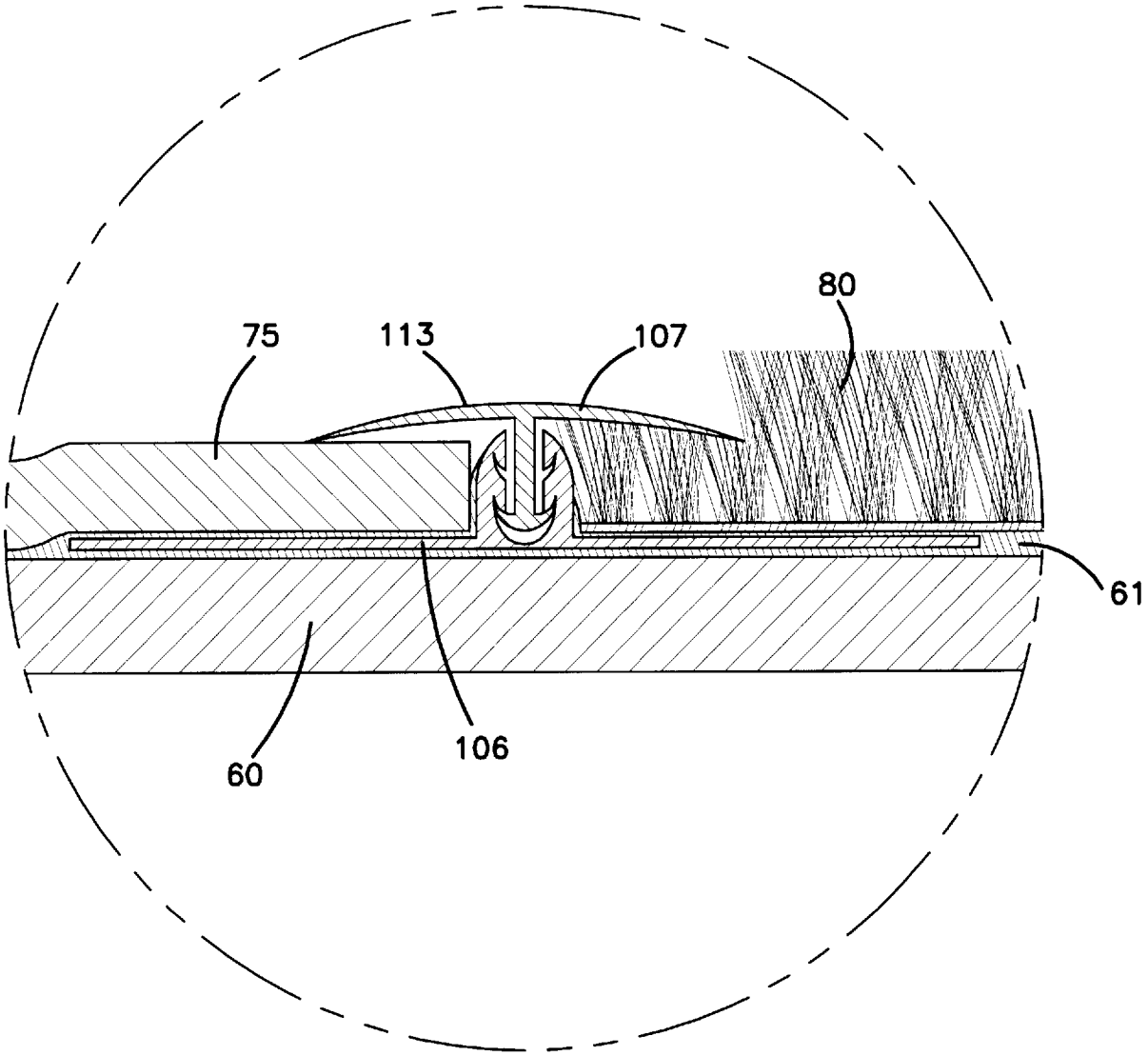
FIG. 12 is a non-exploded view of the arrangement shown in FIG. 11.

An alternate transition strip design is shown in FIGS. 11 and 12. Referring to FIG. 11, a two-piece transition strip is shown at 105, comprising base piece 106 and top piece 107. The base piece 106 includes upwardly extending tabs 108 which can lock with tab 109 in cover 107, during use.

Utilization of the arrangement shown in FIGS. 11 and 12 is apparent from the description of these figures. In general base piece 106 is secured to the subfloor where a seam between vinyl flooring 75 and bristle flooring 80 is to occur. The base piece 106 should be sized that each of its flanges 110 and 111 extends under the associated flooring at least about 1 inch on each side (2 inches total width). The flooring, (i.e. polymeric sheet material 75 or bristled material 80) is then sealed to the associated portion of the base plate. Cover piece or strip 107 is then locked into position, by pressing it downwardly such that tab 109 locks into tabs 108. As indicated in the drawings, this will tend to compress bristles underneath cover piece 107, somewhat. The top plate or piece 107 should be sized and curved, to provide a gentle ramp or transition area 113, between the two flooring materials. Thus a trip hazard, or strong resistance to pushing of a cart across the two surfaces, is avoided. It is foreseen that each of base piece 106 and top piece 107 may be formed in long strips, to be cut to use, through molding from conventional polymeric materials. In general, it is foreseen that vinyl materials will be preferred.

Referring again to FIG. 1, subflooring in area 44 abuts a wall. A method of accomplishing good seal at this location is illustrated in the cross section of FIG. 4.

Figure 4:
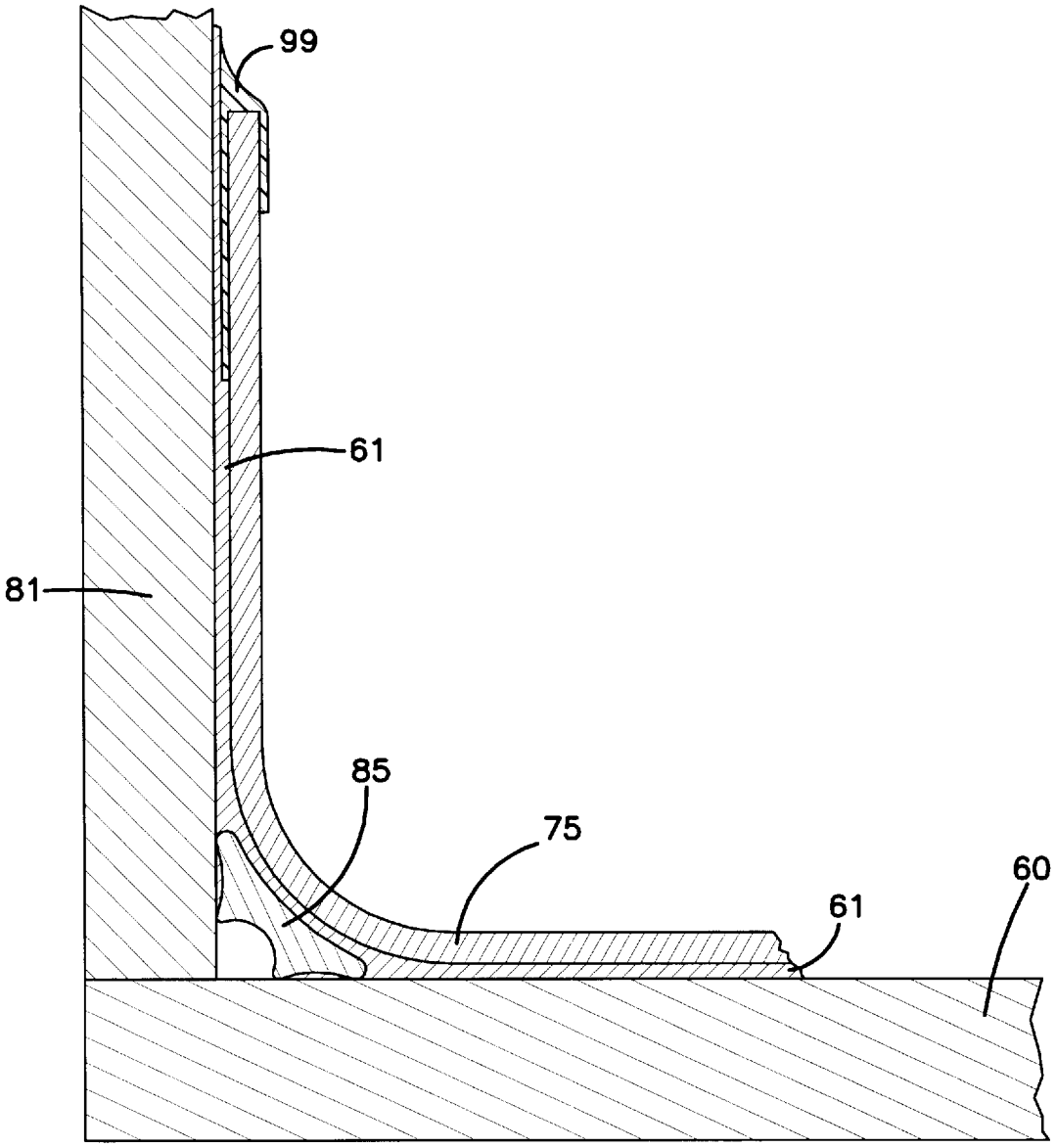
FIG. 4 is an enlarged, fragmentary, schematic cross-sectional view taken along line 4—4, FIG. 1.

Referring to FIG. 4, the subflooring is again indicated generally at 60. Flexible polymeric flooring sheet material of floor 44 is generally indicated at 75. A wall engaged by the material is indicated at 81. Again, cove piece 85 is used. The flexible polymeric material is rolled up the wall, about 4 to 6 inches, and is capped by cap piece 99. That is, the seal in FIG. 4 is generally analogous to that described with respect to FIGS. 5 and 6.

Referring again to FIG. 1, reference numeral 115 generally indicates a drain fixture or drain in the floor. It will be understood that drains 115 may be located at various positions, throughout the floor. Drain 115 is depicted simply to show an example.

Figure 7:
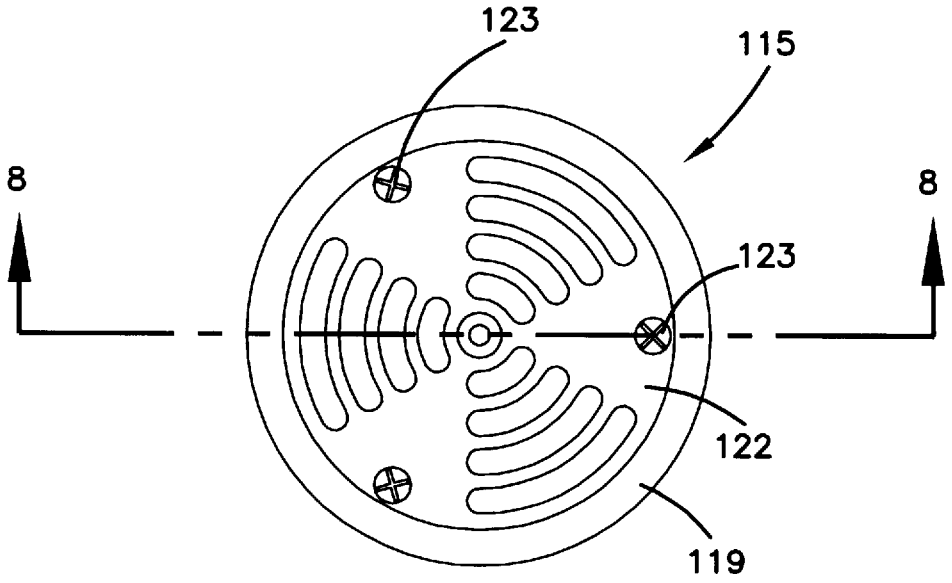
FIG. 7 is an enlarged top plan view of a drain shown in FIG. 1.
Figure 8:
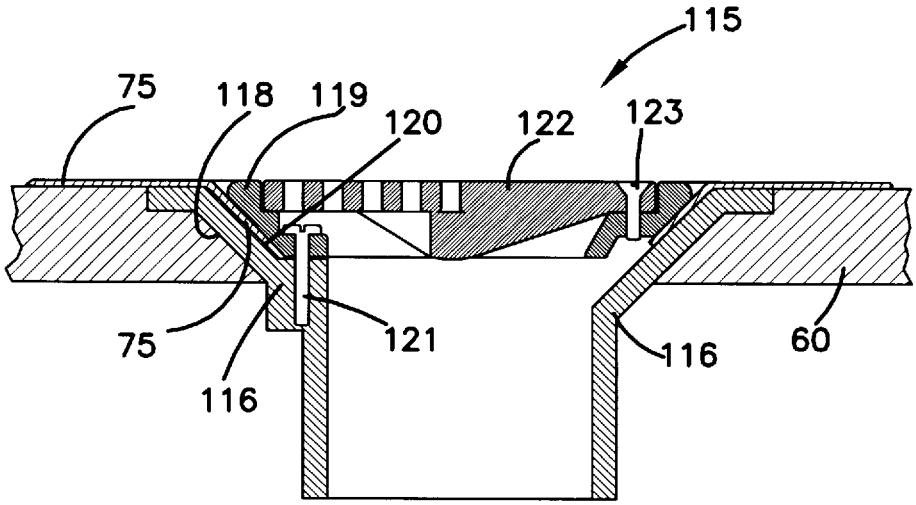
FIG. 8 is a fragmentary, schematic cross-sectional view taken along line 7—7, FIG. 1.

In FIG. 7, drain fixture 115 is shown in top plan view, and in FIG. 8 it is shown in cross section. Referring to FIG. 8, circular drain 115 includes flared exit funnel or pipe 116 positioned underneath surface 75. Because surface 75 comprises a flexible polymeric material, it can be folded or molded to include a portion extending partly down the flared end 118 of pipe 116. Clamp ring 119 is then secured over section 120 of flooring 75 in this location by bolts 121 (only one shown). Thus the problems of sealing tile in the area of the drain are avoided. Rather the flooring simply extends downwardly into the drain 115 at this location. Subflooring damage, in such regions, is thus substantially inhibited. For the particular arrangement shown in FIG. 8, top grid or grate 122 is secured to the clamp ring 119 by bolts 123.

Figure 9:
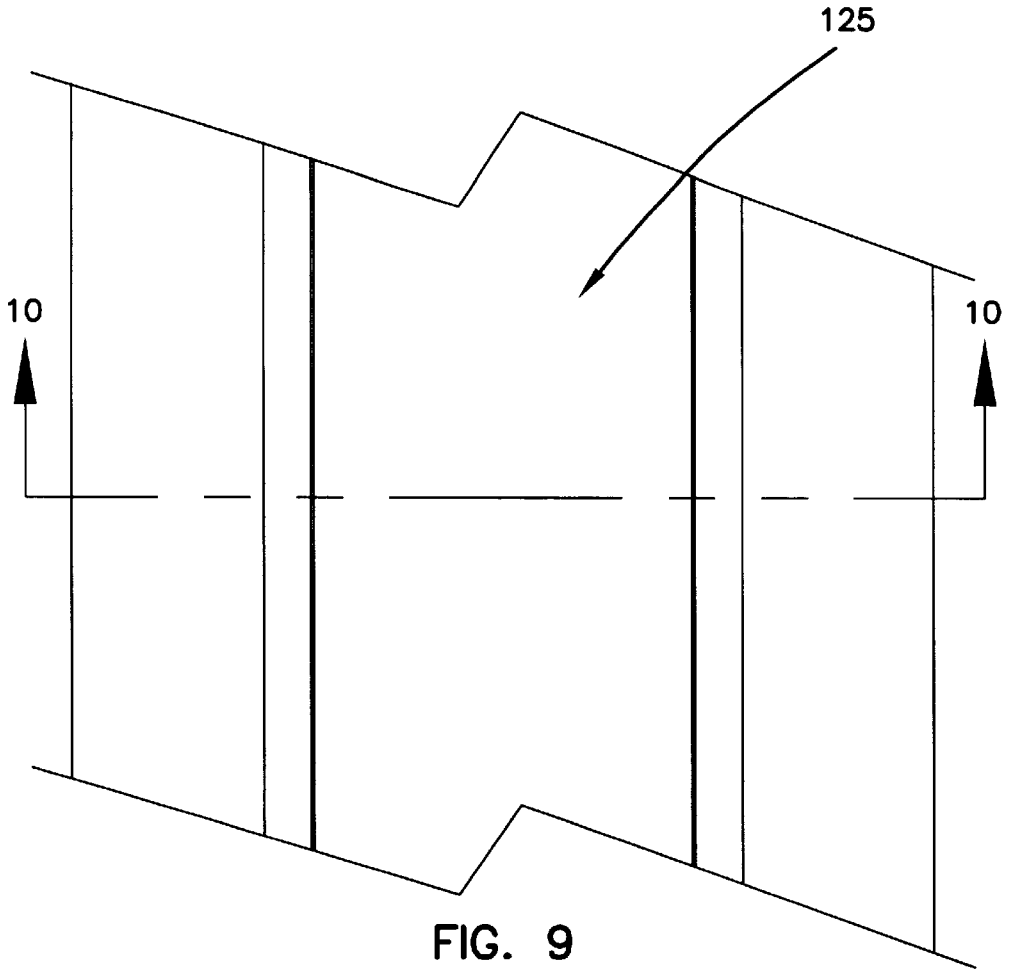
FIG. 9 an enlarged, fragmentary, schematic top plan view of trough depicted in FIG. 1.

In some kitchens, it is desirable to have an extended linear (or elongate) trough into which water or cleaning solution can be pushed, during use. For the flooring system shown in FIG. 1, a cleaning trough is located at 125, extending in front of cooking line 25. Trough 125 is shown in top plan view in FIG. 9, and in cross section in FIG. 10.

Figure 10:
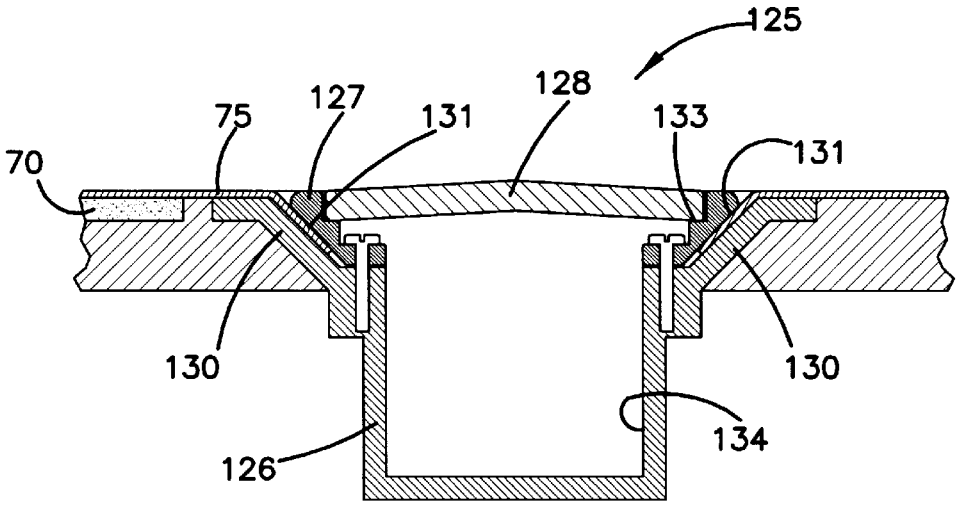
FIG. 10 is a fragmentary, schematic cross-sectional view taken along line 10–10, FIG. 9.

Referring to FIG. 10, the trough includes bottom or trough section 126, clamp rim 127, and top grid 128. In general, bottom section 126 will be anchored in the subfloor. The flexible floor material 75 will be positioned to extend into slanted sidewall sections 130, in the trough base 126, as indicated at 131. Clamp rim 127 is then secured over the flooring 131, to compress same against the trough base 126. Clamp rim 127 includes internal recessed rim or shelf 133. The top grid 128 is simply set on the shelf rim 133, to cover the trough 134. Thus, in cross section, trough 125 has a similar construction to drain 115. However, as is apparent from the top plan view FIG. 1, the drain 115 has a circular construction, and the trough is elongate, typically rectangular.

Securing around upwardly extending fixtures will be apparent from the type of securing techniques used around downwardly extending fixtures such as drain 115 and trough 125. Fixtures which extend upwardly out of the floor may include, for example, pipes, counters, etc. Sealing these regions can be readily accomplished in a manner similar to those utilized for sealing the surface material along the walls, i.e. by rolling upwardly, and/or through utilization of sealant materials such as can be utilized around the downwardly extending fixtures.

Preferred Materials

1. The Coarse Bristled Material Used to Remove Materials from Workers' Shoes

Figure 3:
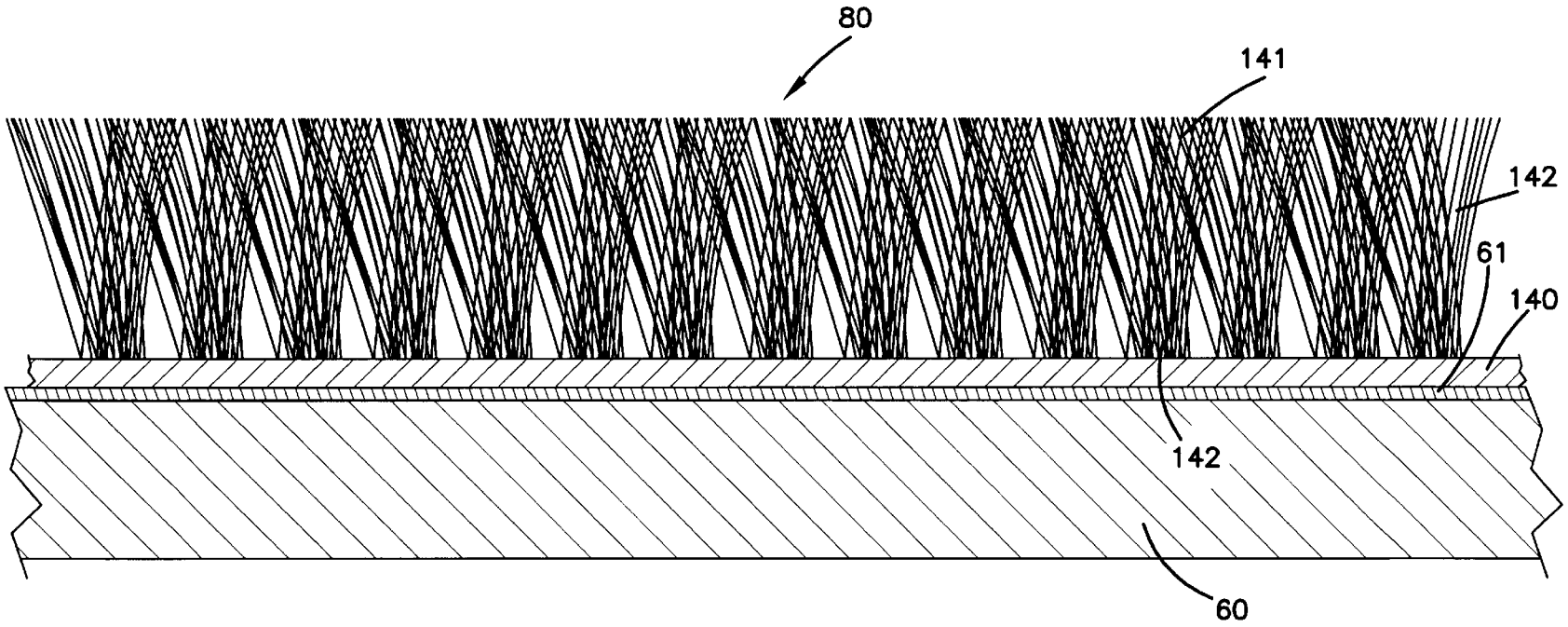
FIG. 3 is an enlarged, fragmentary, schematic cross-sectional view taken along line 3—3, FIG. 1.

Preferably the bristled material 80, FIG. 3, utilized in region 40 is selected from materials having a class A (or class 1) fire rating pursuant to ASTM 648. Preferably it also possesses the smoke density requirements of ASTM-E-662, of under 450. It should be durable and stain resistant, and should be of a material which can catch and trap relatively large amounts of water and dry material, without actually adsorbing or absorbing the trapped material, so that the trapped material can be readily cleaned from the fibers when desired. Heavy fibers, on the order of 80 desitex or more, should be used. Preferably the base backing 140 for the fibers 141 is a strong, water and oil-resistant polymeric material. Most preferably it is a vinyl or latex material. The preferred material for the fibers or bristles is also a polymeric material, preferably nylon 6/6. Most preferably the fibers are in the form of tufts 142, FIG. 3, which are secured to a thin intermediate backing (not viewable) and the intermediate backing is imbedded in the vinyl base or backing material.

Preferred materials are commercially available under the marks: CORAL®, CORAL Plus® and CORAL CLEAN-OFF-ZONE®, from Koninklijke Tufton N.V. (i.e. "Tufton"), Krommenie, Holland. They are available in the United States from Bonar Floors Inc., Elk Grove Village, Ill. 60007. The materials is generally comprised of tufted manufactured 5⁄32inch cut pile. The fiber composition is 100% nylon 6.6 BCF in a non-woven polyester intermediate backing. The polymeric backing, in which the tufted material including the intermediate backing is set, is preferably a fire-resistant latex or vinyl, depending on the particular material chosen. Depending on the product selected, the polyyarn weight is typically about 26–28 oz/yd$^2$. The pile height is at least about (and preferably is about) 0.24 inch.

For the materials available from Tufton, the pile density factor is about 2700–2850 oz/yd$^3$, depending upon the material chosen, with the total weight being 100–110 oz/yd$^2$, again depending on the particular material chosen.

For the commercially available CORAL Plus® materials, the total thickness is about 35.37 inches, with stitches per inch being 7.8–8.0 and stitches per meter$^2$ being 78–82, again depending on the particular material chosen.

In general, the extra fire-resistant versions of CORAL Plus® have preferably a latex backing, rather than the vinyl; and the greater end of the defined pile, total weight, total thickness, stitches per inch, stitches per meter$^2$ and pile yard weight values listed above. For typical applications, the extra fire-resistant versions will be preferred.

2. The Upper Floor Surface in the Work Areas and the High Traffic Areas

The floor surface in the high traffic areas, and also the upper layer of flooring in the areas such as the dishwashing area and the cooking line, is preferably of the same material, as explained above. This would be the material, for example, generally indicated at 65 and 75, FIG. 2. As explained above, preferably polymeric materials, which can be laid down in a manner such that the seams are avoided through hot weld techniques, are preferred. Most preferably, sheets of vinyl material are used. That is, preferably the materials comprise at least 65%, by weight, polyvinyl chloride.

The sheet material may preferably include an antibacterial agent in it, for resistance of the material to bacterial growth therein.

Also, preferably the vinyl material includes grains or filler therein, so that its surface will have a sufficient roughness for skid-resistance, and so that the material resists wear. Grains of corundum (alpha alumina) or quartz would be typical materials used.

One preferred flooring material is commercially available under the general designation "ALTRO Safety Floors", with the specific commercial designation ALTRO STRONG-HOLD 35, from Altro Floors, Los Altos, Calif. 94022. In general, the material has a thickness of about 3.5 mm and a weight of about 4.2 kg/m$^2$. Its slip resistance (when tested in accordance with ASTM D2047) is as follows: static coefficient of friction—Dry, 0.95; static coefficient of friction—Wet, 0.93. It is a Class 1 (ASTM E-648) fire-resistant material. It has an abrasive wear index of 436 (ASTM C501). Commercial Altro marketing materials reference U.S. Pat. No. 4,584,209 with respect to this substance. It is foreseen that in some applications thicknesses other than about 3.5 mm will be preferred. For example, in some bar areas flooring material of about 2.5 mm may be preferred.

3. The Underlayment in the Work Areas

As explained above, in the working areas where workers are expected to stand at stations for extended periods of time, for example in the dishwashing area and the cooking line, underneath the surface flooring is a cushioning underlayment. This is indicated, for example, in FIG. 2 at 70.

The preferred underlayment is a sport facility underlayment, such as might be used under athletic flooring. One such material is available under the mark "VERSAFLEX " from Mondo Sport Division of Mondo America Inc., Laval (Quebec) Canada H7L 3S8. The material has a smooth upper surface and waffled bottom surface, and is available in thickness from about 15/64"to 3/8"(6 mm to 10 mm). The material is calendared and vulcanized with a base of natural rubber, synthetic rubber, mineral aggregates, stabilizing agents and pigmentation. It is thus not readily damaged by water, greases or oils, or biodegradation. In addition, in use it will generally be sealed underneath the upper surface (preferably vinyl).

4. Installation

In general, installation may be conducted utilizing conventional techniques for laying floors, with modifications as discussed above to effect desirable sealing and location of materials. Conventional adhesives for the selected materials may be used in most locations, as long as efforts are made to ensure that a good, tight seal is made at all locations, to ensure resistance against water, oils or bacteria seeping through the upper layers into lower layers, where damage can occur. As explained above, preferably seals to the wall are effected by curling up either the vinyl surface material, the carpet material or both, as appropriate, at these locations, to extend partly up the walls (preferably at least 4–6 inches). Also preferably drains and troughs are set and designed such that the vinyl surface material extends down into them, preferably at least 2–4 inches, providing for better sealing with these fixtures. Sealing around upwardly extending fixtures can be accomplished in manners generally analogous to those used for walls.

Preferred adhesives for the CORAL Plus® fire resistant materials discussed above are: Envirotec 2055, available from W. F. Taylor Co., Inc. of Fontana, Calif. 92337; adhesive 3095, available from Roberts of City of Industry, Calif. 91749; adhesive 356 or 251, available from W. W. Henry Co. of Huntington Park, Calif. 90255; and, Mapei ECO 350(for non-wet areas) or ECO 300, available from Mapei of LaVal, Canada H7L 3JS. Most preferred adhesives, for use in kitchens because of the likelihood of encountering excess moisture, would be Mapei Ultrabond G19; Mapei Ultrabond G21; or W. P. Taylor Enviroxpoxy 501. The identified adhesive materials in this paragraph are those recommended by the marketer and distributor for CORAL Plus® materials.

The preferred adhesives for ALTRO vinyl flooring is Altrofix Epoxy 8421, manufactured and distributed by Altro Floors. This is the material recommended by Altro. Altro recommends, where sealing is to wall surfaces or metal edges of fixtures, etc., that their adhesive Altroseal be used. This material will also be a useful sealant between seal pieces such as strip 100, FIG. 2, and the vinyl floor, as well as between the vinyl or latex backing of the bristle material 80 and the seal piece 106, FIG. 11.

5. Drains and Troughs

Conventional drain can be used for drains, such as drain 115, FIG. 8. One such drain, commercially available, is the type FC 9" diameter two-piece nickel bronze strainer available from Tyler Pipe/Wade Division, Tyler, Tex. 75710.

It is believed that at the present time elongate troughs having a construction analogous to that shown in FIG. 10, are not commercially available. It is believed they can be constructed readily, however, from conventional trough materials using conventional metal working techniques. It is anticipated that stainless steel or cast iron with an ARE coating (epoxy coating resistant to acid) will be preferred for troughs.

What is claimed is:

1. A kitchen comprising:

(A) an entryway to a dining area;

(B) a main kitchen traffic area adjacent to said entryway;

(C) a food preparation line adjacent to said main kitchen traffic area; said food preparation line including cooking equipment and a work area;

(D) a dishwashing area adjacent to said main kitchen traffic area; said dishwashing area including dishwashing equipment; and (E) a continuous, floor area; said continuous, floor area including:

(i) a first floor area; a second floor area; a third floor area; a fourth floor area; and a subfloor positioned under said first, second, third, and fourth floor areas;

(ii) said first floor area:

(a) being positioned in said entryway; and (b) including bristled flooring secured to said subfloor; said bristled flooring comprising tufts of debris-trapping bristles secured to a flexible polymeric backing; said debris-trapping bristles being constructed and arranged to remove water, dirt, and grease from shoes of a person walking on the bristled flooring;

(iii) said second floor area:

(a) being positioned in said dishwashing area, in front of said dishwashing equipment; and (b) defining a first recess in said subfloor; said first recess including a first cushioning underlayment positioned therein;

(iv) said third floor area:

(a) being positioned in front of said food preparation line; and (b) defining a second recess in said subfloor; said second recess including a second cushioning underlayment positioned therein;

(v) said fourth floor area:

(a) being positioned in said main kitchen traffic area; and (vi) a flexible polymeric flooring sheet material; said flexible polymeric flooring sheet material being:

(a) positioned in said second floor area; over said first cushioning underlayment; and in front of said dishwashing equipment;

(b) positioned in said third floor area; over said second cushioning underlayment; and in front of said food preparation line; and (c) positioned in said fourth floor area in said main kitchen traffic area and abutting said bristled flooring in said first floor area.

2. A kitchen according to claim 1 further including:

(A) a transition seal strip oriented along a seam between said bristled flooring and said flexible polymeric flooring sheet material;

(i) said transition seal strip including a base plate having a first portion secured to said subfloor underneath a portion of said bristled flooring and a second portion secured to said subfloor underneath a portion of said flexible polymeric flooring sheet material; and (ii) said transition seal strip including a top plate having a first section extending over a portion of said bristled flooring and a second section extending over a portion of said flexible flooring sheet material.

3. A kitchen according to claim 2 herein:

(A) said transition seal strip comprises said top plate secured to said base plate by adhesive.

4. A kitchen according to claim 2 wherein:

(A) said transition seal strip comprises a molded piece of polymeric material.

5. A kitchen according to claim 1 wherein:

(A) said tufts of debris-trapping bristles comprises nylon 6/6 bristles; and (B) said flexible polymeric backing of said bristled flooring comprises a vinyl backing.

6. A kitchen according to claim 1 wherein:

(A) said flexible polymeric flooring sheet material comprises a vinyl flooring.

7. A kitchen according to claim 6 wherein:

(A) said vinyl flooring includes a particulate filler in sufficient quantity to provide said vinyl flooring with a skid-resistant upper surface.

8. A kitchen according to claim 1 further including:

(A) a circular drain fixture having a drain funnel and a clamp member;

(i) said flexible polymeric flooring sheet material including a drain portion extending into said drain funnel; and (ii) said clamp member of said drain fixture being secured to said drain funnel with said drain portion of said flexible polymeric flooring sheet material positioned therebetween.

9. A kitchen according to claim 8 wherein:

(A) said drain fixture is positioned in said main kitchen traffic area.

10. A kitchen according to claim 1 further including:

(A) an elongate trough fixture having a base drain, and a clamp member;

(i) said flexible polymeric flooring sheet material including a trough lip extending into said base drain; and (ii) said clamp member of said trough fixture being secured to said base drain with said trough lip of said flexible polymeric flooring sheet material positioned therebetween.

11. A kitchen according to claim 10 wherein:

(A) said trough fixture is positioned in said third floor area, in front of said food preparation line.

12. A kitchen according to claim 10 wherein:

(A) said clamp member includes a recessed grid rim; and (B) said trough fixture includes a grid positioned on said recessed grid rim.

* * * * *